United States Patent [19]

Buchmann et al.

[11] 4,379,652

[45] Apr. 12, 1983

[54] CLOSED ONE-PIECE ROLLER FRAME FOR VIBRATOR ROLLERS

[75] Inventors: Heinz Buchmann; Bruno Mayer, both of Bochum; Wolfgang Szybowicz, Erkrath, all of Fed. Rep. of Germany

[73] Assignee: Thyssen Industrie AG, Fed. Rep. of Germany

[21] Appl. No.: 190,040

[22] Filed: Sep. 23, 1980

[30] Foreign Application Priority Data

Oct. 3, 1979 [DE] Fed. Rep. of Germany ..... 2940048

[51] Int. Cl.[3] ..... E01C 19/38

[52] U.S. Cl. ..... 404/117; 172/776; 172/554; 280/281 R; 180/20

[58] Field of Search ..... 404/117, 122, 123, 124, 404/125, 126, 127, 129; 180/20; 280/274, 281 R; 172/554, 776

[56] References Cited

U.S. PATENT DOCUMENTS

| | | | |
|---|---|---|---|
| 554,421 | 2/1896 | Heggem | 180/20 |
| 986,290 | 3/1911 | Holt | 180/20 |
| 1,292,273 | 1/1919 | Downey | 180/20 |
| 1,304,741 | 5/1919 | Cartwright | 404/126 |
| 2,334,086 | 11/1943 | Greiner | 180/20 |
| 2,925,759 | 2/1960 | Hillis | 180/20 |
| 3,255,682 | 6/1966 | Hedstrom | 404/117 |
| 3,554,101 | 1/1971 | Grant | 404/129 |
| 3,988,071 | 10/1976 | Cochran | 404/129 |

*Primary Examiner*—Nile C. Byers, Jr.
*Attorney, Agent, or Firm*—McGlew and Tuttle

[57] ABSTRACT

A vibrator roller frame for supporting a vibrator roller on a horizontal axis of rotation and for transferring static and dynamic forces, comprises, a closed annular one-piece frame member, preferably made of cast steel, having side, end and corner parts, connected to the vibrator roller and annularly surrounding it. The side, end and corner parts are shaped in accordance with the static or dynamic forces they will receive. The corner parts have inside and outside relatively large radii of curvature and connect the side and end parts. The side and end parts have increasing width from a median axis toward the corner portions.

6 Claims, 3 Drawing Figures

CLOSED ONE-PIECE ROLLER FRAME FOR VIBRATOR ROLLERS

FIELD AND BACKGROUND OF THE INVENTION

The present invention relates to roller frames in general and, in particular, to a new and useful closed annular vibrator roller frame which rotatably carries a vibrator roller with hydraulic motor and connecting gears.

Roller frames for supporting vibrator rollers are known in general. These roller frames are rectangular or square in plan and essentially consist of four straight steel sections joined by welded seams at the corner regions of the roller frame. Lobes are welded on inside the roller frame. In addition, the roller frame is provided with several connection bores. A manufacturer is not free in arranging the lobes and connection bores in the individual vibrator rollers because it is necessary to mount, in or near these rollers, at least one hydraulic motor for the drive of the unbalance generator, and a planetary gear located inside the vibrator roller. In the known welded roller frames, as a rule, at least two parallel frame sides are made of relatively thick-walled sections, while the two other frame sides or ends which connect the thick-walled frame parts are much thinner. This results in a drastic difference in mass in the transitional corner regions, where the roller frame is welded together. These welded roll frames very often break in the corner regions.

SUMMARY OF THE INVENTION

It is an object of the present invention to form a roller frame in a manner such that it is not destroyed, even after prolonged operation, due to dynamic and/or static load or forces applied to the frame.

Another object of the present invention is to provide a vibrator roller frame for supporting a vibrator roller on a horizontal axis of rotation and for transferring static and/or dynamic forces from the vibrator roller, comprising, a closed annular one-piece, preferably cast steel, frame member having side, end and corner portions, connected to the vibrator roller and annularly surrounding the same, with the side, end and corner parts being shaped and having thicknesses according to the static and dynamic forces which will be applied thereto.

Some of the advantages of the invention are as follows: If a roller frame is designed according to the invention, a favorable mass distribution results and, hence, a favorable course of the lines of force. As a result, the considerable static and/or dynamic loads of such a roller frame can no longer lead to rupture of the roller frame, as in the prior art. Particularly, the previously much endangered corner regions are designed in the roller frame according to the invention so that rupture no longer occurs, while the attachment dimensions, in particular for the disposition of a hydraulic motor and of a planetary gear, need not be changed from conventional roll frames, but may remain identical.

A further object of the present invention is to provide such a closed one-piece roller frame which has rounded corner parts with relatively large inside and outside radii of curvature for connecting the side and end parts together.

Another object of the invention is to form the side and end parts with ever increasing thickness from a median axis of the frame which is perpendicular to the rotational axis of the vibrator roller.

A still further object of the present invention is to provide such a frame wherein the side and end parts are trapezoidal in shape from the median axis to the beginning of the corner parts.

With the design according to the invention a favorable mass distribution results inside the walls of the roller frame and, hence, favorable load conditions occur when the frame is exposed to dynamic effects.

The invention also has as one of its objects the provision of a roller frame which is simple in design, rugged in construction and economical to manufacture.

The various features of novelty which characterize the invention are pointed out with particularity in the claims annexed to and forming a part of this disclosure. For an understanding of the invention, its operating advantages and specific objects attained by its uses, reference is made to the accompanying drawing and descriptive matter in which a preferred embodiment of the invention is illustrated.

DESCRIPTION OF THE PREFERRED EMBODIMENT

Figure 1:
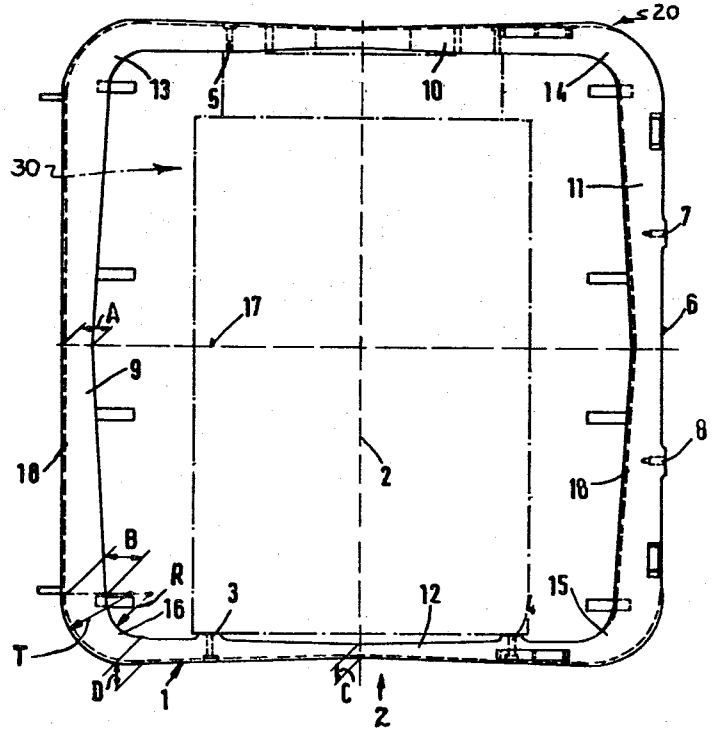
FIG. 1 is a top plan view of a roller frame constructed in accordance with the present invention.
Figure 2:
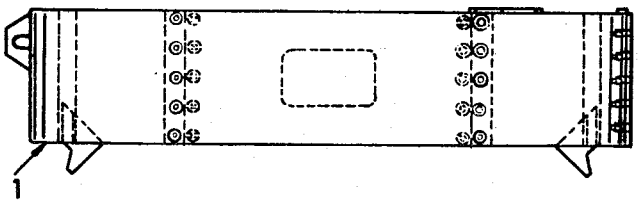
FIG. 2 is a side elevational view taken in the direction of arrow 2 of FIG. 1.

Turning to the drawing in particular, the invention embodied therein, comprises, a closed one-piece annular vibrator roller frame member, generally designated 20, for for supporting a vibrator roller assembly, shown in phantom line, and generally designated 30.

The roller frame 1 shown in plan in FIG. 1 has a substantially rectangular form. Reference number 2 designates the center line or horizontal axis of rotation of a vibrator roller which is part of the assembly 30. The roller receives in its interior a hydraulic motor and a planetary gear with unbalance generator. The hydraulic motor is disposed at the bores 3, 4, while the planetary gear is connected on the opposite roller frame end, inter alia, with the bore 5. The roller frame 1 is connected to a suitable machine (not shown) on edge 6 of a side part 11 through bores 7 and 8, possibly indirectly, to such a machine.

FIG. 1 indicates that roller frame 1 is formed by four frame portions 9, 10, 11 and 12, which, as to material, are connected together in one piece. The roller frame 1 indicated in the drawing was made in cast steel.

The frame portions 9 to 12 are rounded along large radii R and T in the contiguous corner regions or portions 13, 14, 15 and 16. The arrangement is such that the frame side portions 9 and 11 widen from the transverse median axis 17 to the respective corner region 13 and 14 and 15 and 16, respectively, in a manner such that, from the transverse median axis 17 to the beginning of the radius R, T of the respective corner region 13 to 16, the respective frame side portions 9 and 11 widens in trapezoidal form. The minor base A coincides with the transverse median axis 17, while the major base B of the trapeze lies at the beginning of the radii R, T. The mass distribution inside these trapezoidal frame portions 9, 11 and of the corner regions 13 to 16 is such that the static and/or dynamic loads are easily absorbed by the roller frame 1 and that an undisturbed course of the lines of force results within the frame portions 9 to 12 and the corner regions. The pair of side portions 9, 11 are thus connected to the pair of end portions 10, 12 by the four corner portions 13, 14, 15 and 16.

The broken line 18, which is visible in FIG. 1, designates a body edge which results from the fact that the roller frame 1 tapers conically toward the side which is not seen in FIG. 1. This makes the roller frame 1 easy to shape and cast.

In addition, the frame end portions 10 and 12 are substantially trapezoidal in the plan view seen in FIG. 1, with the minor base C coinciding with the center line 2, while the major base D lies in the terminal region of the radii R, T. Here also, the mass distribution is such that there results the already mentioned favorable course of the lines of force within these parts of roller frame 1.

Figure 3:
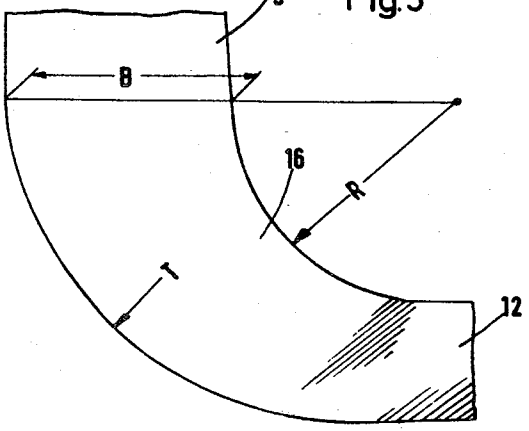
FIG. 3 is a top plan enlarged view of a corner part or section of the invention shown in FIG. 1.

From FIG. 3, it is clearly seen that the center of radius R lies on the prolongation of base B, namely, in the interior of roller frame 1.

The features described in the specification and claims and shown in the drawing may be essential for the realization of the invention both singly and in any combinations.

While a specific embodiment of the invention has been shown and described in detail to illustrate the application of the principles of the invention, it will be understood that the invention may be embodied otherwise without departing from such principles.

What is claimed is:

1. A vibrator roller assembly and frame comprising a vibrator roller with a horizontal axis of rotation and an unbalance generator, a closed angular one-piece vibrator roller frame member having a pair of side portions, a pair of end portions and four corner portions connected between said side portions and said end portions respectively, said axis of said vibrator roller connected between said end portions so that static and dynamic forces are transferred from said vibrator roller to said frame member, said four corner portions being internally and externally rounded, said side portions having increasing widths from a median axis of said frame extending perpendicularly to said axis of rotation, said end portions having increasing widths from said axis of rotation, and from the median and horizontal axes to each corner portion, each side and end portion being trapezoidal in shape.

2. A vibrator roller frame, as claimed in claim 1, wherein the corner portions are internally and externally rounded about respective inner and outer relatively large radii.

3. A vibrator roller frame, as claimed in claim 1, wherein said side and end portions are substantially of equal length.

4. A vibrator roller frame, as claimed in claim 1, wherein the end parts are connected to the vibrator and the end portions are thinner in width than the side portions.

5. A vibrator roller frame, as claimed in claim 1, wherein the corner portions are internally and externally rounded by radii at least as long as the width of the side and end portions adjacent the corner portions.

6. A vibrator roller frame according to claim 1, wherein said member is made of cast steel, each of said side, end and corner portions tapered in a direction transverse to the median axis and the horizontal axis.

* * * * *